US005209672A

United States Patent [19]

Hatanaka

[11] Patent Number: 5,209,672

[45] Date of Patent: May 11, 1993

[54] TWO-PIECE CONNECTOR AND METHOD OF PRESS-CONNECTING FLAT CABLES TOGETHER

[75] Inventor: Mutsuo Hatanaka, Tama, Japan

[73] Assignee: KEL Corporation, Tokyo, Japan

[21] Appl. No.: 798,039

[22] Filed: Nov. 20, 1991

Related U.S. Application Data

[60] Continuation of Ser. No. 617,312, Nov. 23, 1990, abandoned, which is a division of Ser. No. 493,251, Mar. 14, 1990, Pat. No. 5,017,149.

[30] Foreign Application Priority Data

Mar. 18, 1989 [JP] Japan ..... 1-66529

[51] Int. Cl.[5] ..... H01R 13/62

[52] U.S. Cl. ..... 439/157; 439/404; 439/492; 29/857

[58] Field of Search ..... 439/157, 404, 405, 406, 439/407, 395–400, 417–419, 492; 29/861, 33 M, 33 K, 566.3, 749, 857

[56] References Cited

U.S. PATENT DOCUMENTS

| | | | |
|---|---|---|---|
| 4,006,957 | 2/1977 | Naronzy | 339/103 |
| 4,009,922 | 3/1977 | Aysta | 339/99 |
| 4,143,935 | 3/1979 | Goodman | 339/99 |
| 4,148,130 | 4/1979 | Stauffer et al. | 29/566.3 |
| 4,554,733 | 11/1985 | Caveney | 29/749 |
| 4,563,810 | 1/1986 | Adlon et al. | 29/749 |
| 4,566,164 | 1/1986 | Brown et al. | 29/566.3 X |
| 4,584,757 | 4/1986 | Adlon et al. | 29/566.3 X |
| 4,668,039 | 5/1987 | Marzili | 439/404 |
| 4,713,025 | 12/1987 | Soma | 439/752 |
| 4,753,608 | 6/1988 | Yamaguchi . | |
| 4,839,962 | 6/1989 | Long, Jr. | 29/749 |
| 4,870,752 | 10/1989 | Brown et al. | 29/749 X |
| 4,903,403 | 2/1990 | Brown et al. | 29/861 |
| 4,997,388 | 3/1991 | Dale et al. | 439/404 |

FOREIGN PATENT DOCUMENTS

| | | |
|---|---|---|
| 57-49347 | 7/1979 | Japan . |
| 58-79989 | 8/1983 | Japan . |
| 63-56576 | 4/1988 | Japan . |

*Primary Examiner*—David L. Pirlot
*Attorney, Agent, or Firm*—Robert W. J. Usher

[57] ABSTRACT

A two-piece connector having a header, a receptacle, a first group of contacts incorporated in the header, and a second group of contacts incorporated in the receptacle. The header can be inserted into the receptacle. When the receptacle is inserted into the header, the contacts of the first group are electrically connected to those of the second group. Lock lever engaging bodies are formed on both sides of the header. Lock levers are provided on both sides of the receptacle. Each lock lever has a lift pawl and a lock pawl. These pawls can engage with the upper and lower surfaces of the lock lever engaging body corresponding to the lock lever. They are arranged such that the lock lever engaging body is located between them when the receptacle is inserted in the header. The header and the receptacle are designed so that no surface contacts occur between the lock levers and the lock lever engaging bodies once the header has been inserted into the receptacle, with the lock pawls set in a closed state.

19 Claims, 20 Drawing Sheets

TWO-PIECE CONNECTOR AND METHOD OF PRESS-CONNECTING FLAT CABLES TOGETHER

This is a continuation of Ser. No. 07/617,312 filed Nov. 23, 1990, now abandoned, which was a division of application Ser. No. 07/493,251 filed Mar. 14, 1990, which has issued as U.S. Pat. No. 5,017,149 on May 21, 1991.

BACKGROUND OF THE INVENTION

1. Field of the Invention

This invention relates to a two-piece connector comprising a receptacle and a header (plug) detachably connected with each other and to a method of press-connecting a flat cable with a two-piece connector.

2. Description of the Related Art

An example of a two-piece connector is disclosed in Japanese Laid-open Patent Application No. Sho 58-145074. FIG. 20 is an exploded perspective view of this conventional two-piece connector which comprises a receptacle (male connector) 60 and a header (female connector) 64. The receptacle 60 has handles 61 pivoted to the right and left sides of an insulator by means of pins 62 and a flat cable 63 pressed against contacts (not shown) in the insulator and project outwards therefrom. As shown in FIGS. 21 and 22, each handle 61 is provided with a pawl 61*a* and a lifting portion 61*b*, and also has a holding portion 61*c* at its upper portion. On the other hand, the header 64 has pawl engaging portions 64*a* provided on the right and left sides of the insulator and received in grooves between the pawls 61*a* and the corresponding lift portions 61*b*. The header 64 has contacts 65 penetrating through and fixed to the insulator.

This structure allows an operator to remove the receptacle 60 from the header 64 fixed to printing board 66 with his single hand. Specifically, when the header 64 is removed from the receptacle 60, the holding portions 61*c* of the handles 61 are strongly held by the operator with the thumb and the index finger of his single hand, as shown in FIG. 16. The left and right handles 61 are rotated so as to approach each other and the pawls 61*a* are disengaged from the pawl engaging portions 64*a* of the header 64. At the same time, the lift portions 61*b* of the handles 61 push the insulator of the header 64 to permit the insulator at the side of the receptacle 60 to be pulled out of the header 64.

In this conventional connector, however, it is necessary to insert the receptacles 60 in the header 64 in a state in which the right and left handles 61 are opened, i.e., the pawls 61*a* and the lift portions 61*b* are set in an outwardly rotated state as shown in FIG. 17. If the receptacle 60 is to be inserted in the header 64 with the handles 61 left in an inwardly rotated state as shown in FIG. 16, the pawls 61*a* and the lift portions 61*b* hit against the insulator of the receptacle 60, preventing the receptacle 60 from being placed in the header 64. If the receptacle 60 were forcibly inserted in the header 61, on the other hand, the handles 61 would be broken. Since most users do not know the structures of OA devices (office automation devices), wrong handling incurs fatal trouble or breakage of the devices.

SUMMARY OF THE INVENTION

An object of this invention is to provide a two-piece connector in which the receptacle can be removed from a header by an operator with his single hand and the receptacle can be inserted in the header without setting a lock lever in a open state, thereby to improve the operativeness.

Another object of this invention is to provide a method of connecting a flat cable with a two-piece connector without pitch errors at press-contacting portions between the cores of a flat cable and the contacts of the receptacle.

A still further object of this invention is to provide a press-contacting type contact which is easy to be machined and by which the cores of a flat cable are neither damaged nor broken with ease.

A two-piece connector of this invention comprises a header and a receptacle which are adapted to be connected with and disconnected from each other. The head has an header insulator fixed by a plurality of contacts. The header also has a receptacle insulator secured by a plurality of contacts. The connector is provided with lock lever engaging bodies and lock levers. Each lock lever engaging body is formed on the header and has a substantially rectangular cross section. The lock levers are pivoted to the both side end portions of the receptacle and each has a lifting pawl and a locking pawl which are respectively abutted against the upper surface and lower surface of the corresponding lever lock engaging body such that, in a state in which the receptacle is inserted in the header, the lock lever engaging body is positioned between the lifting pawl and the locking pawl. When the receptacle is inserted in the header in a closed state in which the locking pawls of the lock levers approach each other, no surface contact occurs between the lock lever and the lock lever engaging body and/or the lock lever and the header insulator.

In the structure of this invention, the receptacle can be removed from the header by an operator with his single hand, and the lock levers are rotated along the upper edge portions of the header insulator or in a state in point-contact therewith. This arrangement improves the operativeness of the connector because it is unnecessary to render the lock levers set in an opened state.

BRIEF DESCRIPTION OF THE DRAWINGS

Other objects and advantages will be apparent from the following description taken in conjunction with the accompanying drawings in which.

DETAILED DESCRIPTION OF THE PREFERRED EMBODIMENTS

Embodiments of this invention will be explained with reference to the drawings.

Figure 1:
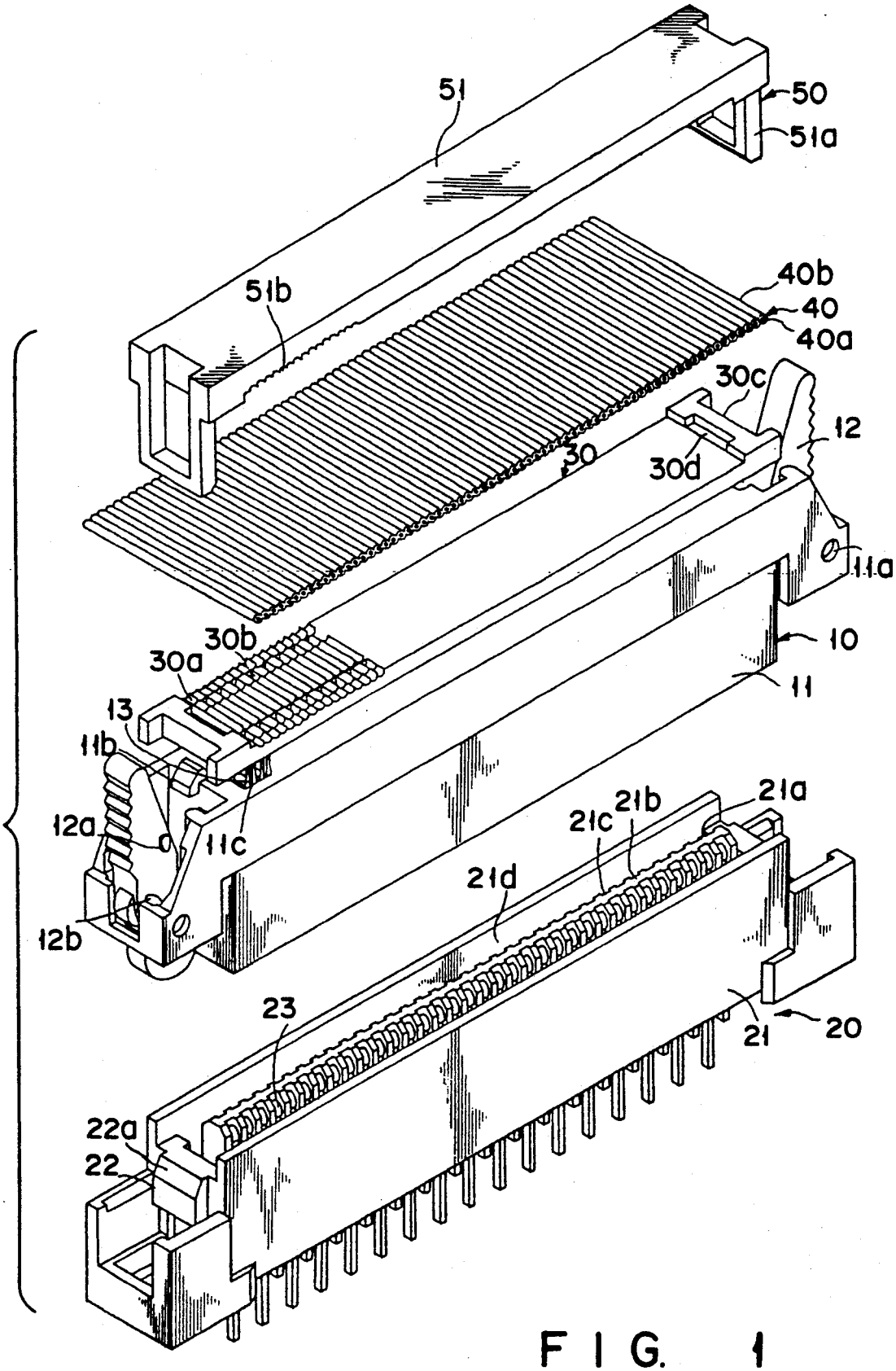
FIG. 1 is an exploded perspective view of a two-piece connector according to the first embodiment of this invention.

FIG. 1 is an exploded perspective view of a press-contact type two-piece connector according to the first embodiment of this invention. The connector comprises a receptacle 10 at the press-contact side, a header 20 at the substrate side, a first cover 30 and a second cover 50.

The receptacle 10 comprises an insulator 11, lock levers 12 and contacts 13. The insulator 11 has a rectangular parallelepiped shape and is provided on the right and left ends with supporting portions in which are formed pin receiving holes 11*a* for pivotally supporting pins 12*b* of the lock levers 12 described later in detail. Two engaging projections 11*b* (only one shown in FIG. 1) are formed on each of the right and left end walls of the insulator 11. In the upper surface of the insulator 11 are formed two elongated holes in which a plurality of contacts 13 are arranged in two rows and contact inserting holes which are disposed under the elongated holes and firmly hold the contacts inserted therein. In the undersurface of the insulator 11 is formed an elongated rectangular-paralellepiped hole (not shown) having a predetermined size and such a predetermined depth that receives the contact plug portion 21*b* of the later described header 20. A plurality of partition walls are arranged at regular intervals in the inner wall of the latter elongated hole. In grooves defined between the partition walls are formed contact holes 11*c* for firmly receiving the later described contacts 13.

Figure 2A:
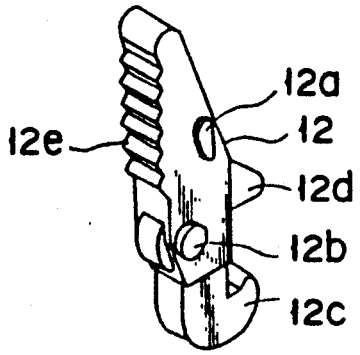
FIGS. 2(*a*) and 2(*b*) are perspective front and rear views, respectively, of the lock lever of the connector of FIG. 1.
Figure 2B:
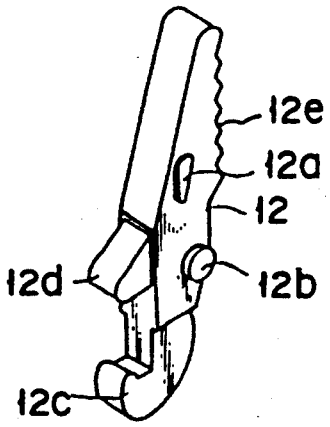

As shown by the perspective views in FIGS. 2(*a*) and 2(*b*), each of the lock levers 12 supported on the right and left side end portions of the insulator 11 is provided on its side end portions with projections 12*a* for confirming the engaging state and pins 12*b* acting as the centers of rotation and on the lower end with a lock pawl 12*c*. The lock lever 12 is formed with a lift pawl 12*d* disposed opposed to the lock pawl 12*c* and a holding portion 12*e* on the upper side face.

Figure 3A:
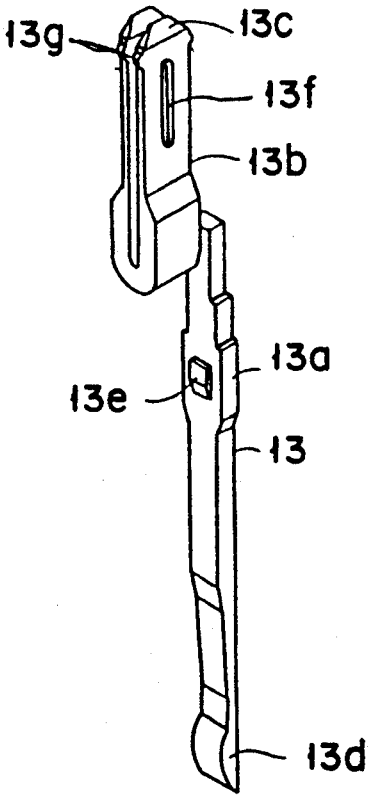
FIGS. 3(*a*) and 3(*b*) are perspective views of the contacts of the connector of FIG. 1.
Figure 3B:
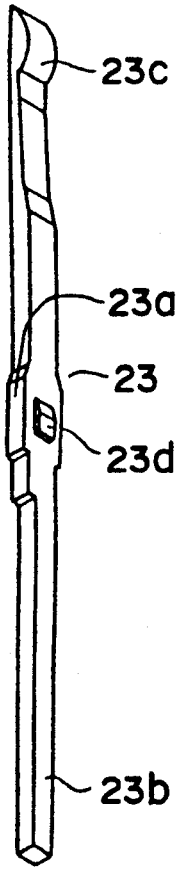

Each contact 13 has the structure as shown in FIG. 3(*a*). The contact 13 is provided on its substantial central part of substantial plate-shaped section with engaging portions 13*a* and 13*e* which cause the contacts 13 to engage the contact inserting holes of the insulator 11, on the upper portion with a press-contacting portion 13*b* and on the lower portion with a contacting portion 13*d*. The press-contacting portion 13*b* is made of a belt member formed in a U-shape. The opposed arm portions of the U-shaped press-contacting portion 13*b* except for its connecting part is made thin by squeezing or the like. In the central part of each arm portion is formed an inwardly projecting portion 13*f* by means of a press. On the tip of the arm portion is formed an edge portion 13*c* for cutting the insulating layer 40*b* of a flat cable 40. Both sides of the edge portion 13*c* form guiding tapers. An R-shaped latch portion 13*g* is formed on the base of the edge portion 13*c* so as to be inserted in the first cover 30 under pressure.

As explained above, the press-contacting portion 13*b* of the contact 13 is made of two thin plates integrally connected together. The cores 40*a* of the flat cable 40 are held between these plates to allow the cores 40*a* to contact one another. Therefore, the contact 13 is easily machined, the cores 40 are neither damaged nor broken readily, and the pitch error between the contacts 13 and the flat cables 40 does not occur with ease.

The header 20 comprises an insulator 21 and contacts 23. A groove 21*d* is formed in the contact plug portion 21*b* and the proximity thereof so as to receive the lower portion of the insulator 11. A plurality of partition walls 21*a* are formed at regular intervals on the central wall of the contact plug portion 21*b*. The contacts 23 are arranged in the grooves 21*c* defined between the partition walls 21*a* to extend therealong. A contact-insertion hole (not shown) is formed in the bottom of each groove 21*d*.

As shown in FIG. 3(*b*), the contact 23 has, on its middle part, engaging portions 23*a* and 23*d* for causing the contact 13 to engage the insulator 21, on its top, a contacting portion 23*c* (a vertical, two-point contacting straight beam) for contacting the contacting portion 13*d* of the contact 13, and on the lower end, terminal portion 23*b* for being soldered to the printing board.

Lock lever engaging bodies 22 are integrally formed on the right and left upper side ends of the insulator 21. Each lock lever engaging body 22 has a substantially trapezoidal cross section and integrally formed with an inclined face 22*a* on the outer wall so as to face upward (i.e., to face the lock pawl 12*c*) and a lock pawl receiving groove 22*b* on the lower wall.

The first cover 30 is a thin plate and formed in its plate face with two rows of press-contact inserting holes 30b corresponding to the arrangement of the contacts 13. Guiding grooves 30c are formed in both side ends of the first cover 30 and corrugated flat cable grooves 30a are provided in that upper face portion of the first cover 30 which is not in contact with the insulator 11 so that the insulating layers 40b of the flat cable 40 is fitted in them. Recesses 30d are made in those portions of the contact 30 which are located near the grooves 30c. These recesses 30d are to receive the projections (later described) of the cover 50.

The second cover 50 comprises a plate-like body portion 51, grooves 51c cut in the portion 51, for preventing the press-contacting portions 13b from expanding when the flat cable 40 is press-connected and U-shaped engaging frame portions 51a integrally formed on both side ends of the body portion 51. In the undersurface (the face facing the first cover 30) of the body portion 51 are formed flat cable grooves 51b so that the insulating layers 40a of the flat cable 40 is fitted in them. Projections 51c protrude from those parts of the portion 51 which are located near the portions 51a. These projections can be fitted in the recesses 30d.

Referring to FIGS. 8 to 12, the method of connecting the flat cable 40 with the two-piece connector of this embodiment will be explained. As shown in FIG. 8, the contacts 13 are inserted in the contact inserting holes 11b of the insulator 11 under pressure and held therein by the engaging portions 13a and 13e in a fixed state.

Next, the engaging frame portions 51a of the second cover 50 are inserted and fixed in grooves in the base of a press-contact jig, not shown, with the engaging frame portions 51a directed upwardly. Then, the flat cable 40 is placed in the flat cable grooves 51b of the second cover 50. The first cover 30 is brought above the second cover 50 and the engaging frame portions 51a are inserted in the guiding grooves 30c.

Thereafter, the lower portions of the engaging projecting portions 11b formed on both ends of the receptacle 10 are engaged with the upper ends of the engaging frame portions 51a. Also, the latch portions 13g formed on the edge portions 13c of the contacts 13 are inserted into the holes 30b of the first cover 30. FIG. 8 shows this state.

Since the latch portions 13g and the edge portions 13c (the two opposed plate portions) of each contact 13 are inserted, under pressure, in the corresponding press-contact inserting holes 30a of the first cover 30, and the first cover 30 is held by the latch portion 13g, the misalignment of the positions of the edge portion 13c of the contacts 13 is corrected. When the receptacle 10 is pushed down in this condition, thereby abutting the cover 30 onto the cover 50. The projections of the second cover 50 are thereby inserted into the recesses of the cover 30. Then, the flat cable 40 held between in the flat cable grooves 51b of the second cover 50 and the flat cable grooves 30b of the first cover 30 has its pitch corrected to the pitch of the grooves 51b and 30b. The cores 40a are thereby held in the gaps between the edge portions 13c of the contacts 13.

Figure 9A:
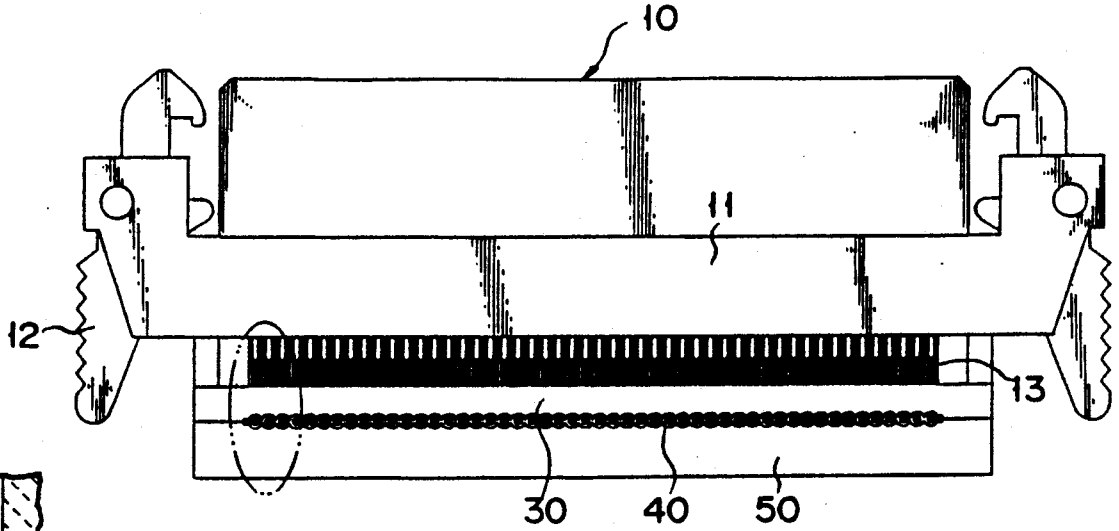
FIG. 9A is an expanded view of the indicated portion of FIG. 9.
Figure 9B:
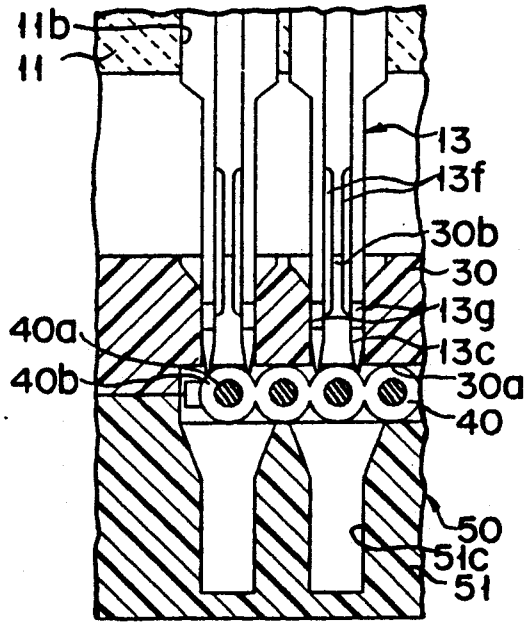
FIG. 9 is a view of the connector in the second stage of the method, at which the cores of the flat cable are set apart at intervals defined by first and second covers.
Figure 10A:
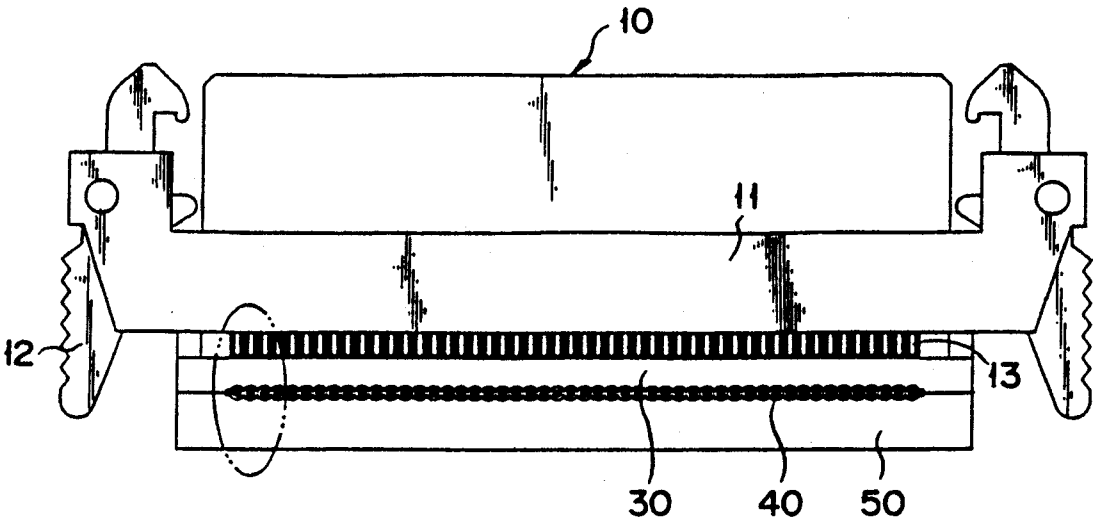
FIG. 10A is an expanded view of the indicated portion of FIG. 10.
Figure 10B:
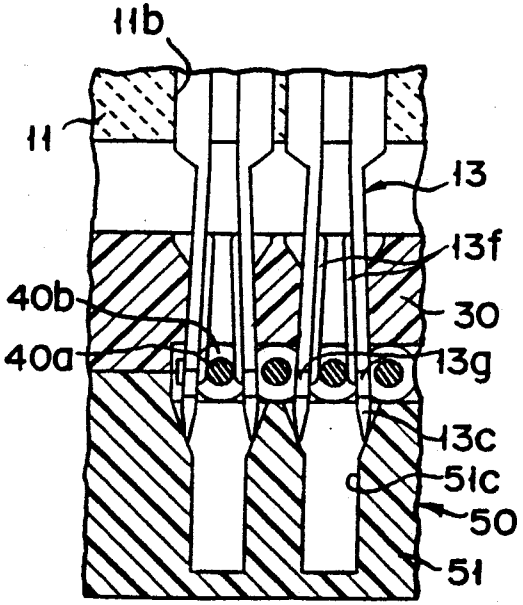
FIG. 10 is a view of the connector in the third stage of the method, at which the press-contacting portion of the contacts separate the cores of the flat cable, from one another.
Figure 11A:
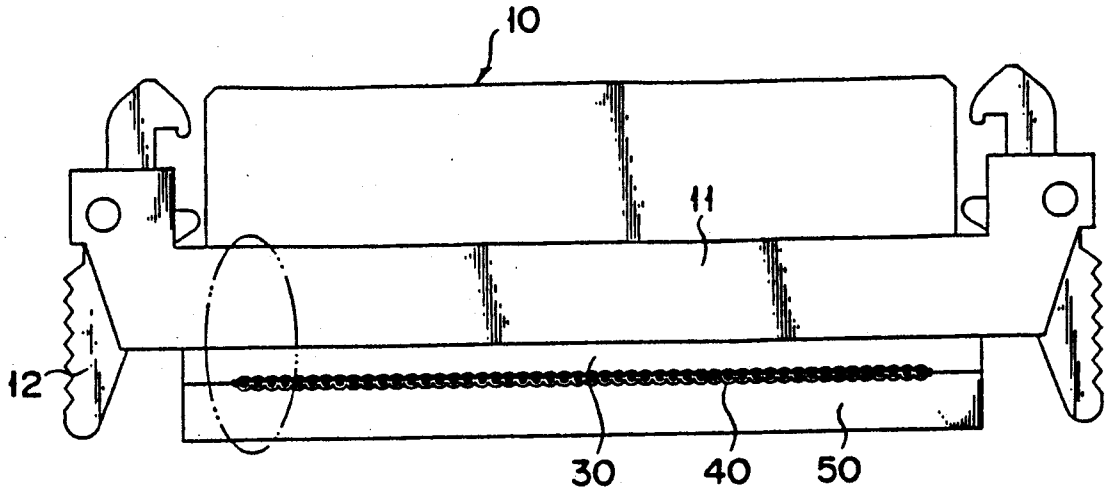
FIG. 11A is an expanded view of the indicated portion of FIG. 11.
Figure 11B:
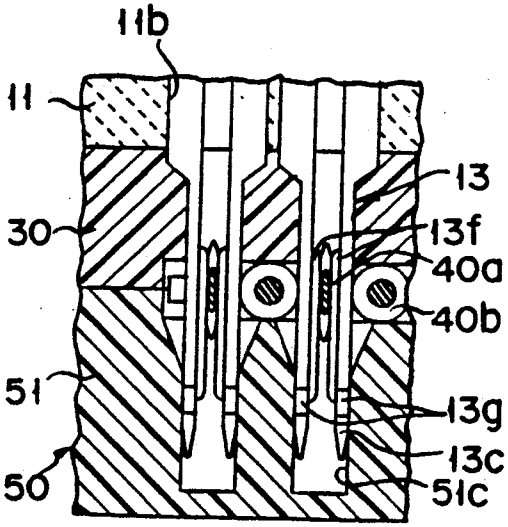
FIG. 11 is a view of the connector in the last stage of the method, at which the flat cable is completely press-connected.

As the receptacle 10 is further pushed downward by a press, (not shown), from the position FIG. 9, each contact 13 means further downward, overcoming the friction between the first cover 30 and the latch portion 13g. The edge portions (thin portions) 13c of the contacts 13 are thereby inserted into the press-contact inserting holes 30b of the first cover 30 under pressure, as is shown in FIG. 10. As the portions 13c are inserted into the holes 30b, they are guided to the cores 40a. At the final stage, the edge portions 13c of the contacts 13 are completely inserted to predetermined positions in the first cover 30 under pressure, as is shown in FIG. 11. Since the latch portions 13g are located near the edge portions 13c, they hold the first cover 30 until the flat cable 40 is press-connected. Further, the grooves 30b are formed in the first cover 30, and the groove 51b are formed in the second cover 50. These facts ensure that no pitch error of the flat cable 40 occurs and the edge portion 13c of the contacts 13 and the covers 40a of the flat cable 40 are in press-contact with each other at predetermined positions. The projections (not shown), which protrude from those parts of the portion 51 which are located near the portions 51, prevent the flat cable 40 from moving sideways after the cable 40 has been set in place in the cover 50.

Figure 12:
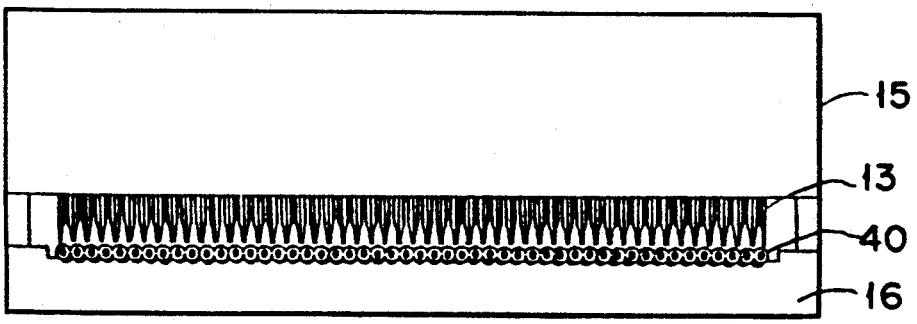
FIG. 12 ia a view explaining a conventional method of press-connecting a flat cable.

With the conventional press-contact method as shown in FIG. 12, the flat cable 40 is placed on the cover 16. Thereafter, the contacts 13 fixed to the main body of the receptacle (insulator) 15 are put on the cover 11 and is pressed. In this case, the pitch error is likely to occur by the shocks produced in the steps of setting the flat cable and/or the contacts 13 and/or during the pressing, making it difficult to accurately place the flat cable 40 under pressure at a predetermined position.

Figure 4:
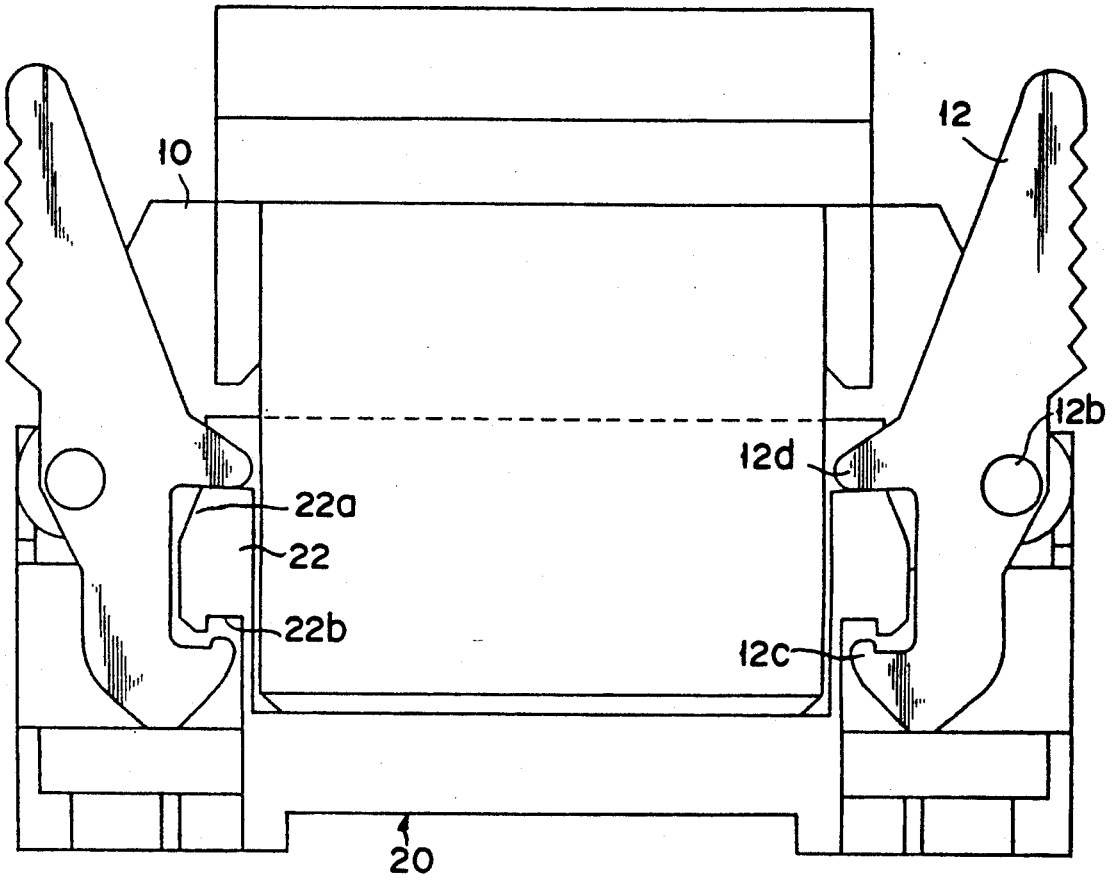
FIG. 4 is a front view of the connector in which the header is fully inserted in the receptacle.
Figure 5:
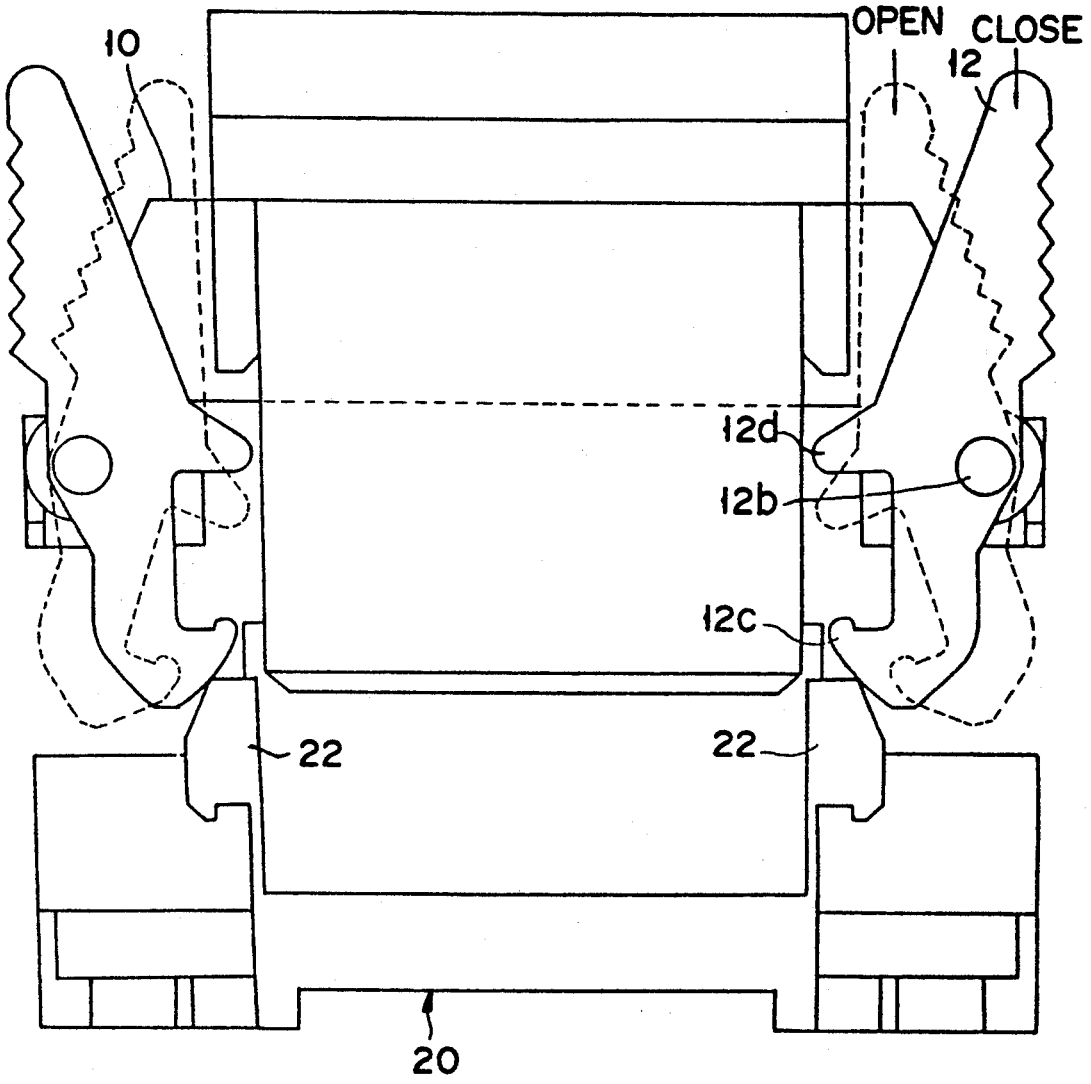
FIG. 5 is a front view of the connector in which the header is inserted into the receptacle.
Figure 6A:
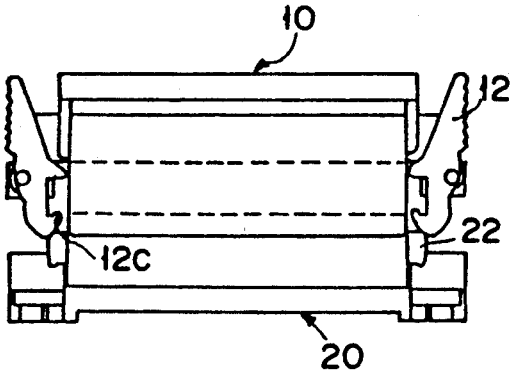
FIGS. 6(*a*) to 6(*g*) show the process in which the lock levers are closed, and the header is being inserted in the receptacle.
Figure 6B:
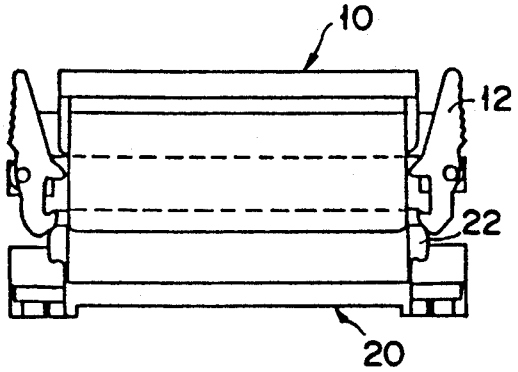
Figure 6C:
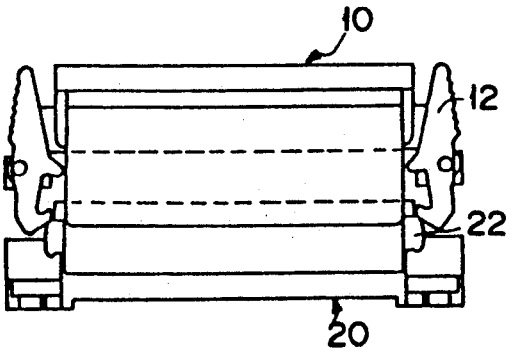
Figure 6D:
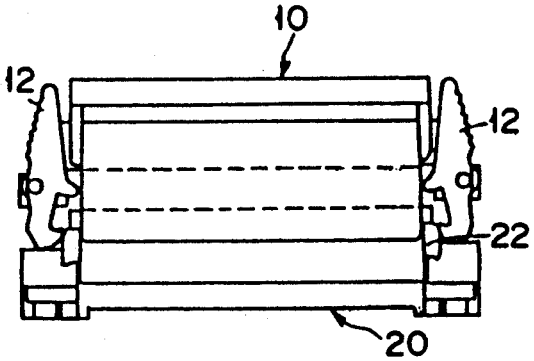
Figure 6E:
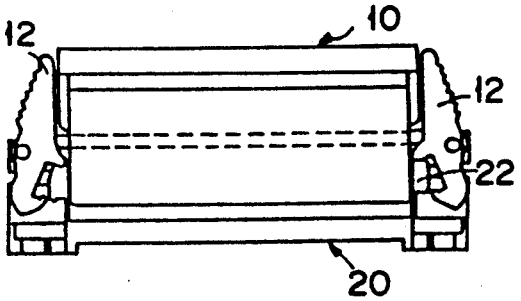
Figure 6F:
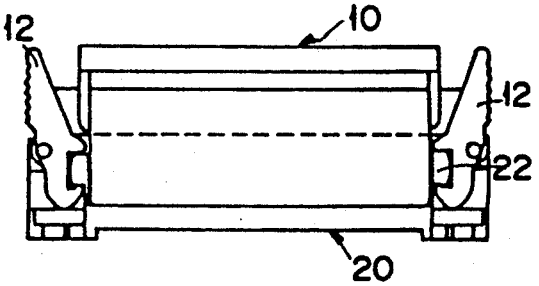
Figure 6G:
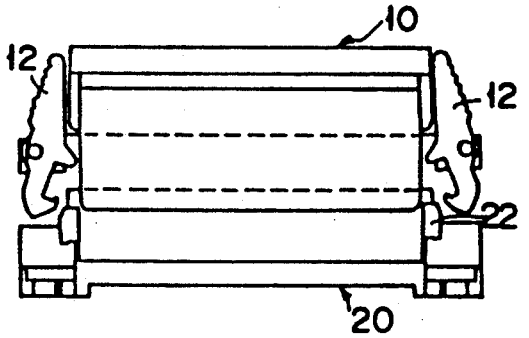

Referring to FIGS. 4, 5 and 6(*a*) to 6(*g*), the operation as to how to remove the header 29 from the receptacle 10 will be explained. FIG. 4 shows the state in which the receptacle 10 is completely inserted in the header 20 and the lift pawls 12d of the lock levers 12 abut against the upper faces of the lock lever engaging bodies 22. When the right and left lock levers 12 are strongly held and rotated inwardly by the operator with the thumb and the index finger of his single hand, the lock pawls 12c are disengaged from the lock pawl inserting grooves 22b of the lock lever engaging bodies 22. At the same time, the lift pawls 12d strongly push the upper faces of the lock lever engaging bodies 22, thus separating the receptacle 10 from the header 20. This is because the pins 12b function as fulcrums, the pawls 12c function as points of action, and the holding portions 12e function as points of force-application. Thereafter, the receptacle 10 can be pulled out while the lock levers 12 are held by the operator with the thumb and the index finger of his single hand.

When this removing process is reversed, the removed receptacle 10 is again inserted in the header 20. FIGS. 5 and 6(*a*) to 6(*g*) illustrate how to connect the receptacle 10 with the header 10. In both cases when the lock levers 12 are rotated outwardly to take an open state as shown by the broken lines in FIG. 5 and they are turned inwardly to assume a closed state as shown by the solid lines in FIG. 5, the receptacle 10 can be inserted in the header 20. FIGS. 6(*a*) to 6(*g*) show the process in which the receptacle 10 is being inserted in the header 20 when the lock levers 12 are in a closed state. FIG. 6(*g*) shows the initial stage in which the receptacle 10 begins to engage the header 20. In this state, the arcuate faces formed on the lock pawls 12c of the lock levers 12 are in a line contact with the inclined faces 22 of the lock lever engaging bodies 22. FIGS. 6(*b*) to 6(*d*) illustrate the states in which the receptacle 10 is gradually inserted deeply in the header 20. FIG. 6(*e*) shows the state in which the receptacle 10 is further deeply inserted in the header 20 and the lift levers 12d of the lock levers 12 are abutted against the upper faces of the lock lever bodies 22. FIG. 6(*f*) indicates the state in which the receptacle 10 is fully inserted in the header 20 and the lock pawls 12*c* and the lift pawls 12*d* are abutted against the lock lever engaging bodies 22.

Even if the lock levers 12 are in the closed state, the lock levers 12 are gradually opened in a line contact with the inclined faces 22*a* of the lock lever engaging bodies 22 as the receptacle 10 is being inserted in the header 20. Therefore, it is unnecessary to intentionally open the lock levers 12 at the initial stage of the insertion of the receptacle 10 in the header 20. This improves the operativeness of the connector.

FIG. 6(*g*) shows the state in which the lock levers 12 is opened. In this case, the lock levers 12 do not hit against the lock lever engaging bodies 22 like in the conventional case. Thus, the receptacle 10 can be inserted in the header 20 without any trouble.

Figure 7:
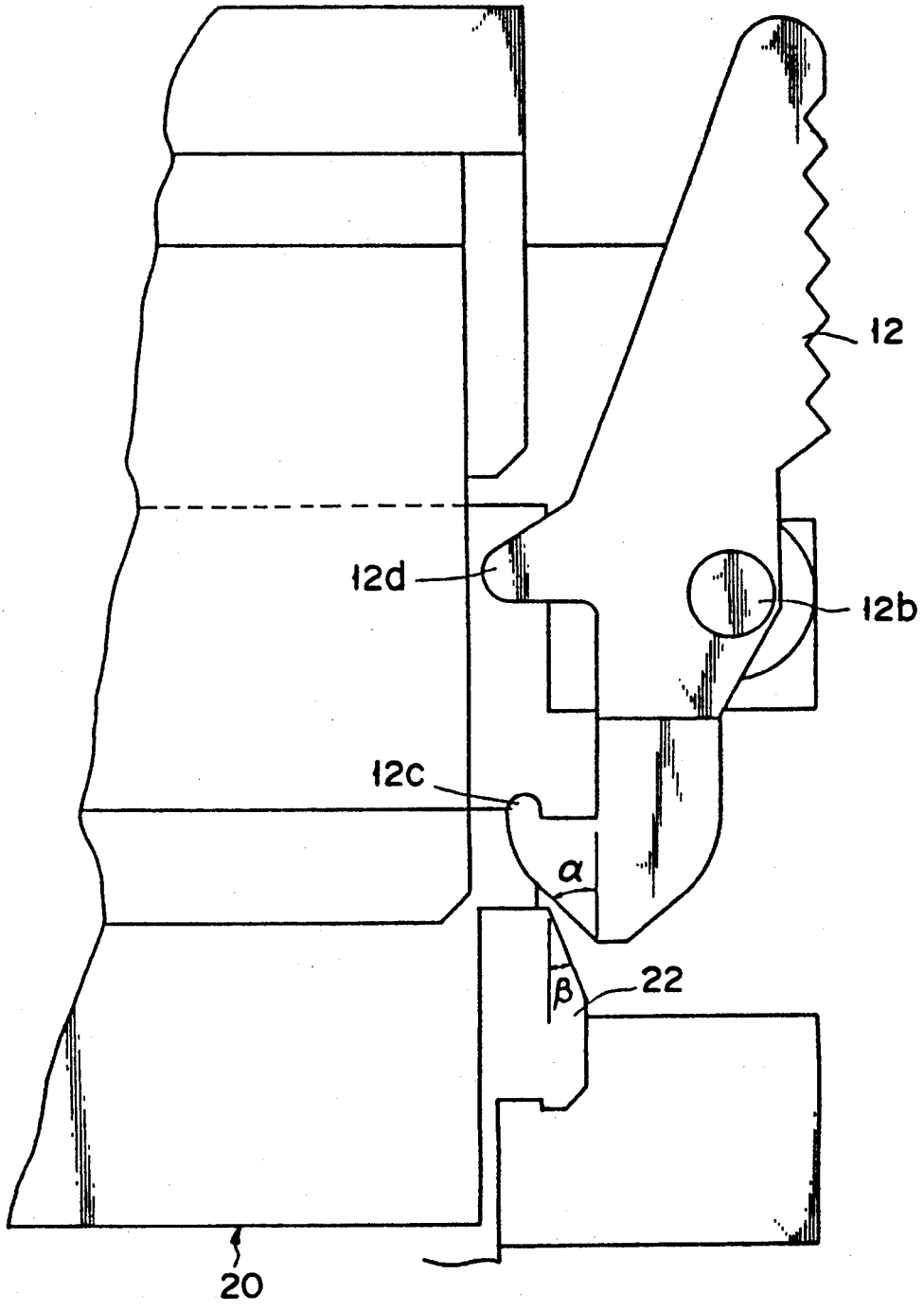
FIG. 7 is a front view of the main part of a modification of the connector of FIG. 1.

FIG. 7 illustrates the relation between the lock lever 12 and the lock lever engaging body 22. The angle of inclination &B of the inclined face 22*a* of the lock lever engaging body 22 may be within the rage between 10 degrees to 45 degrees, and the angle of inclination &A of the lock pawl 12*c* of the lock lever 12 may be within the range between 45 degrees and 80 degrees. Further, an inclined face may be replaced by an arcuate face.

Figure 13:
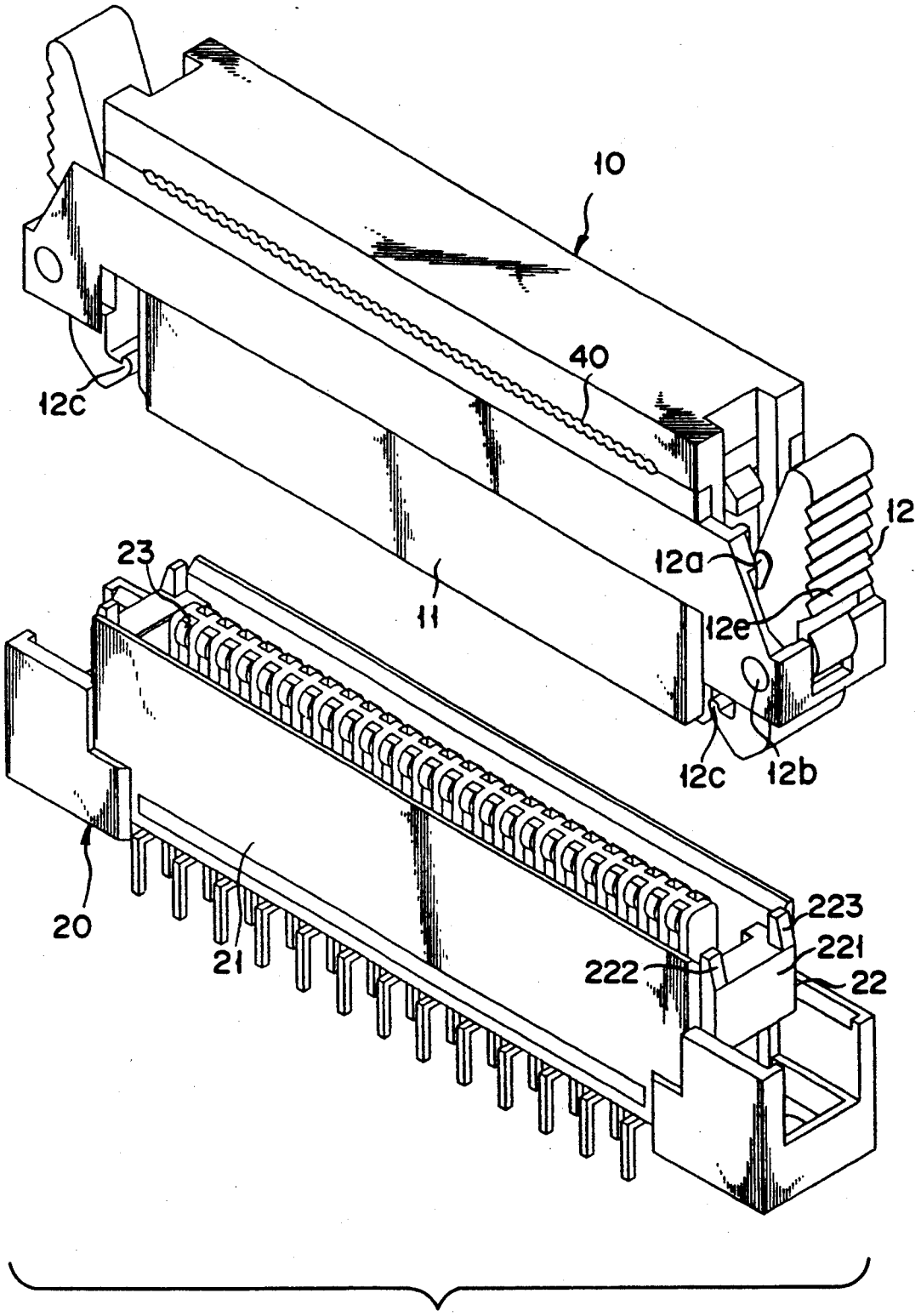
FIG. 13 is an exploded perspective view of a two-piece connector which is a second embodiment of the present invention.

FIG. 13 is an exploded perspective view of the second embodiment of a two-piece connector according to this invention in the state in which the receptacle 10 is removed from the header 20 (the lever 12 is closed). The connector of this embodiment only differs from that of the first embodiment in the structure of the lock levers 12 and the lock lever engaging bodies 22. Each lock lever body 22 comprises an engaging main body 221 having a substantially rectangular cross section and inclined pieces 222 and 223 integrally formed on both side end portions of the upper surface of the engaging main body 221 and disposed at such a space that the lock pawl 12*c* of the later described lock lever 12 is inserted therebetween. The inclined pieces 222 and 223 have the same function as the inclined faces of the first embodiment.

Figure 14A:
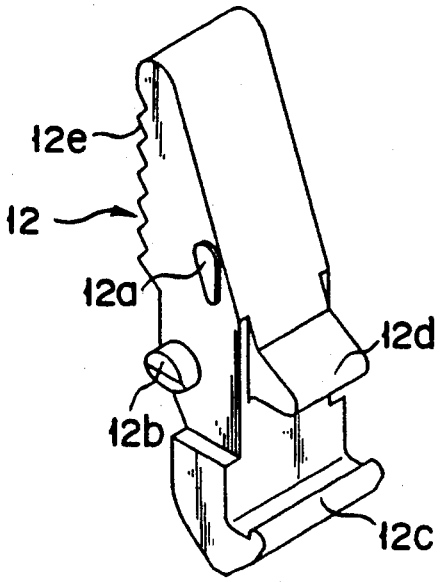
FIGS. 14(*a*) and 14(*b*) are perspective front and rear views of the lock lever of the connector illustrated in FIG. 13.
Figure 14B:
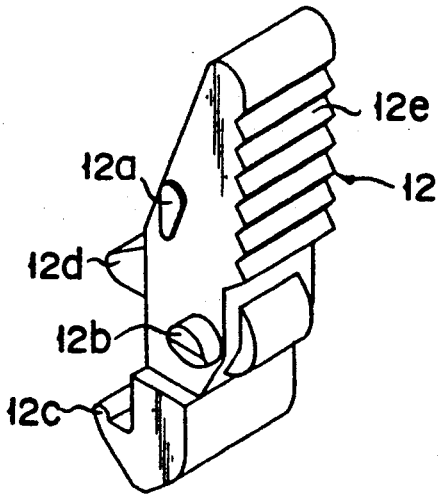

Similarly to the first embodiment, a lock pawl inserting groove 224, not shown in FIG. 12 but in FIG. 13, is formed in the lower portion of the engaging main body 221. In the similar manner to the first embodiment, the lock lever 12 has state confirmation projections 12*a*, pins 12*b*, a lock pawl 12*c*, a lift pawl 12*d* and a holding portion 12*e*, as is illustrated in FIGS. 14(*a*) and 14(*b*). This embodiment differs from the first embodiment in that the lock pawl 12*c* is made wider than the lift pawl 12*d* and the holding portion 12*e*.

The second embodiment as constructed in the above-mentioned manner has the similar technical advantages to the first embodiment.

Figure 15:
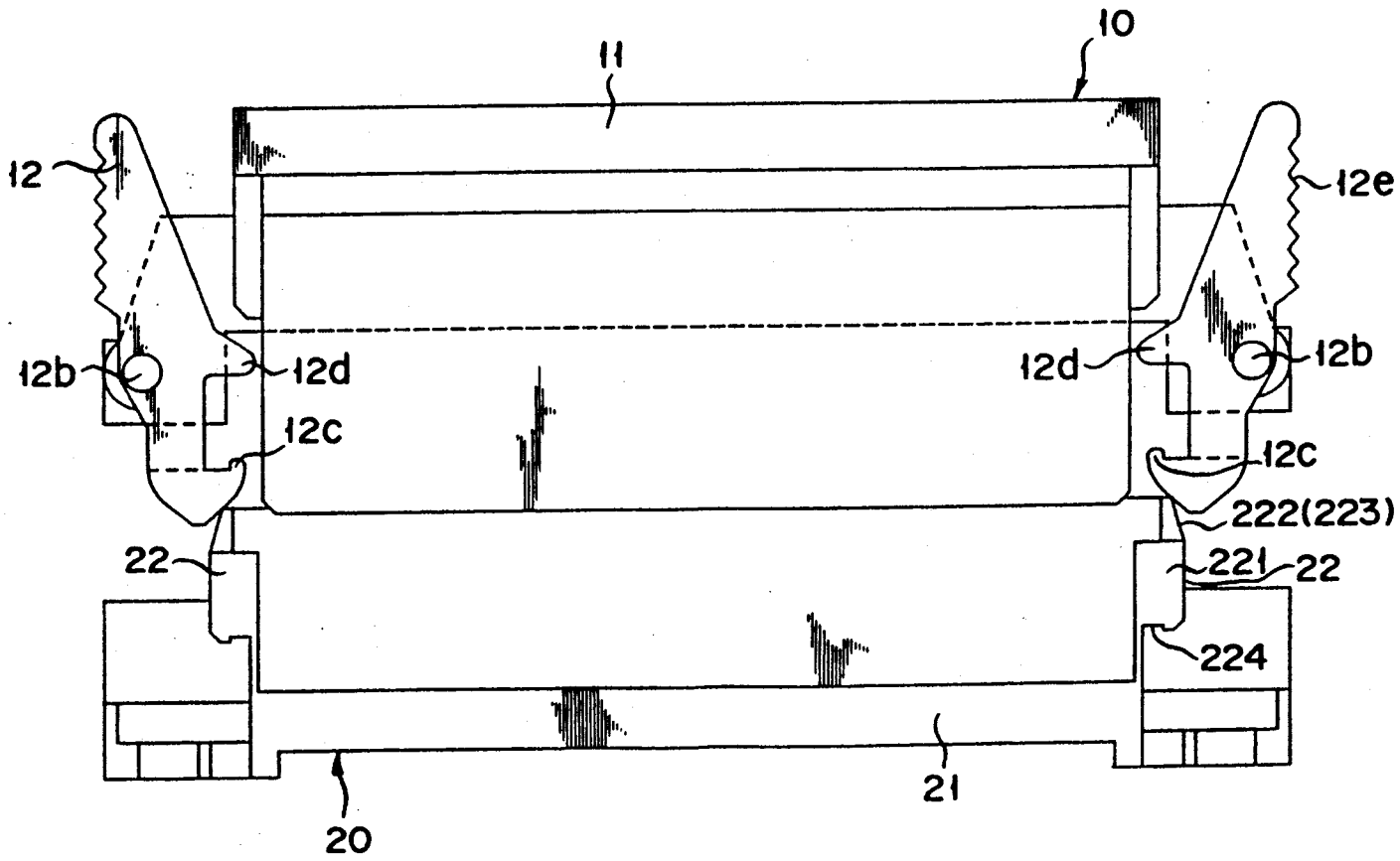
FIG. 15 is a view showing the connector (FIG. 13) with its plug being inserted into its receptacle.
Figure 16:
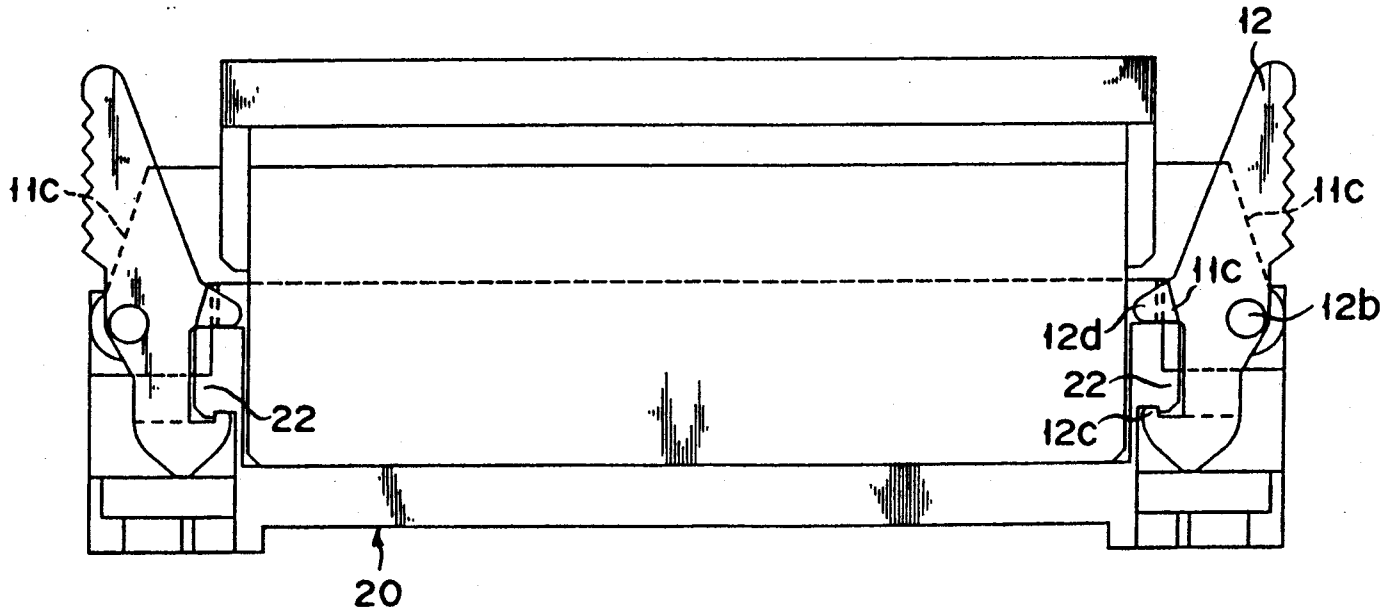
FIG. 16 is a view showing the connector (FIG. 13), with the plug completely inserted in the receptacle.

FIG. 15 shows the state in which the receptacle 10 begins to be inserted in the header 20, and FIG. 16 showed the state in which the receptacle 10 is fully inserted in the header 20.

Figure 17:
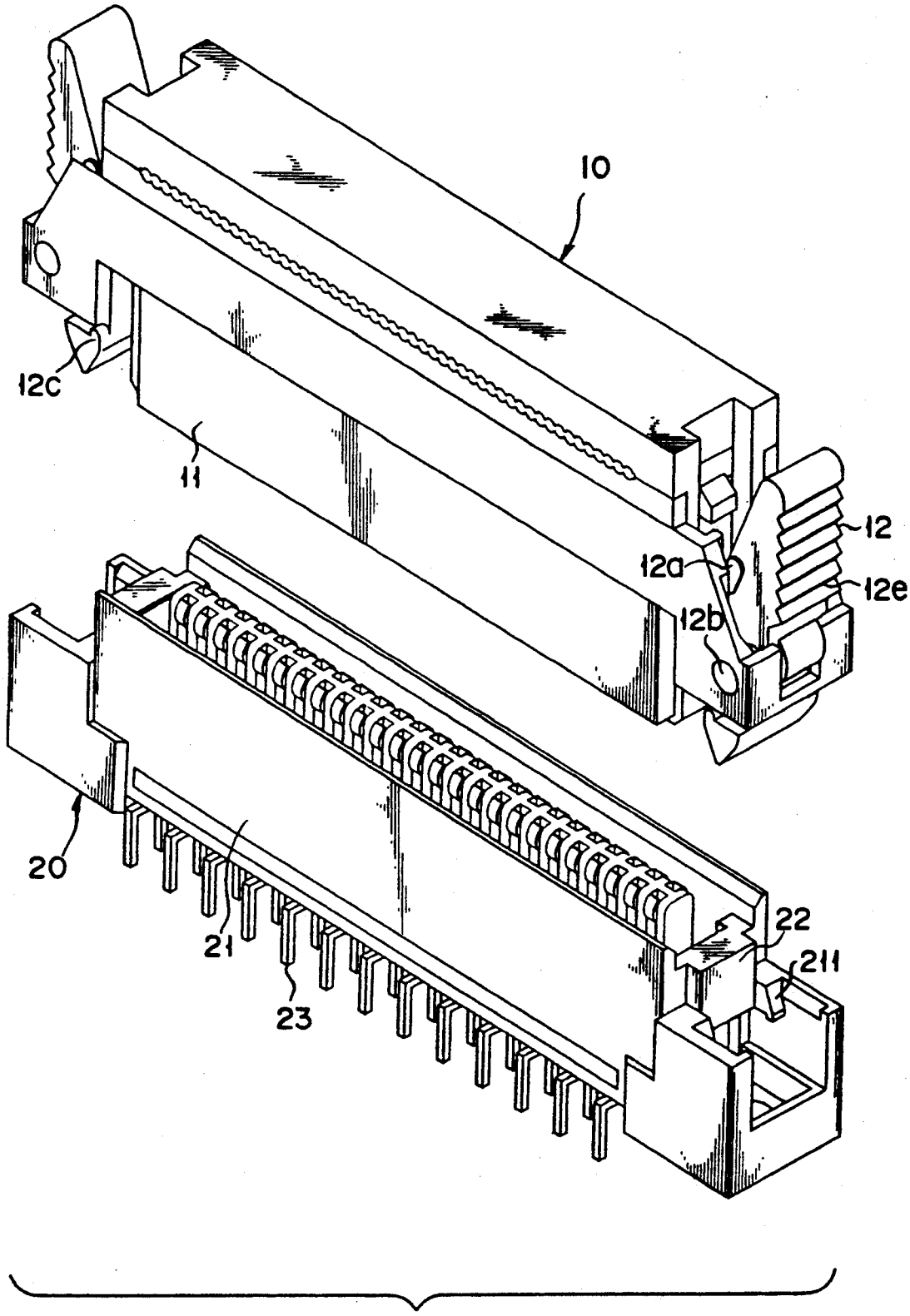
FIG. 17 is an exploded perspective view of a two-piece connector which is a third embodiment of the present invention.
Figure 18A:
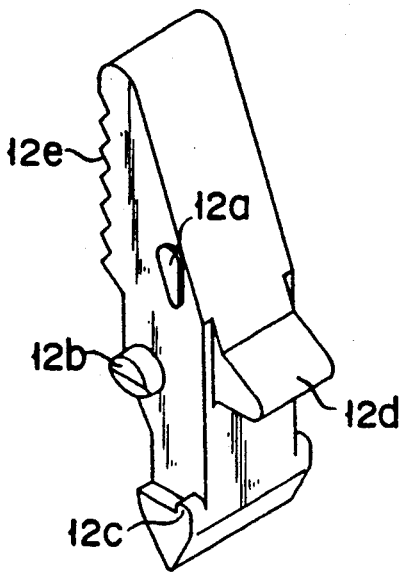
FIGS. 18(*a*) and 18(*b*) are perspective front and rear views of the lock lever of the connector illustrated in FIG. 17.
Figure 18B:
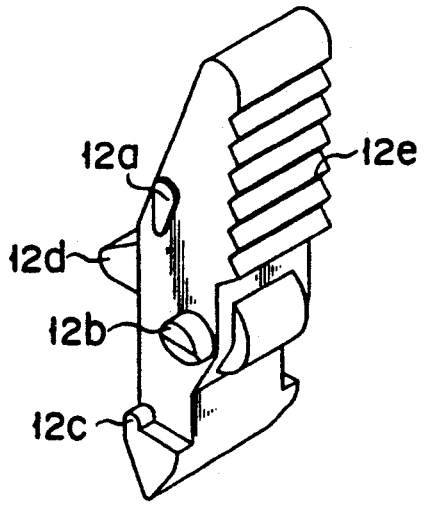

FIG. 17 is an exploded perspective view of a two-piece connector according to a third embodiment of the present invention, with a receptacle 10 and a header 20 separated from each other (that is, with a lock lever 12 closed). The third embodiment differs from the first embodiment in that lock lever engaging bodies 22 and header insulator 21 have specific structures. The lock lever engaging bodies 22 are engaging bodies 225 having a rectangular cross section. The insulator 21 has projections 221 at both ends. These projections 221 are located below the engaging bodies 225 and have an inclined surface. They perform the same function as the inclined surfaces 22*a* shown in FIG. 1.

Figure 8A:
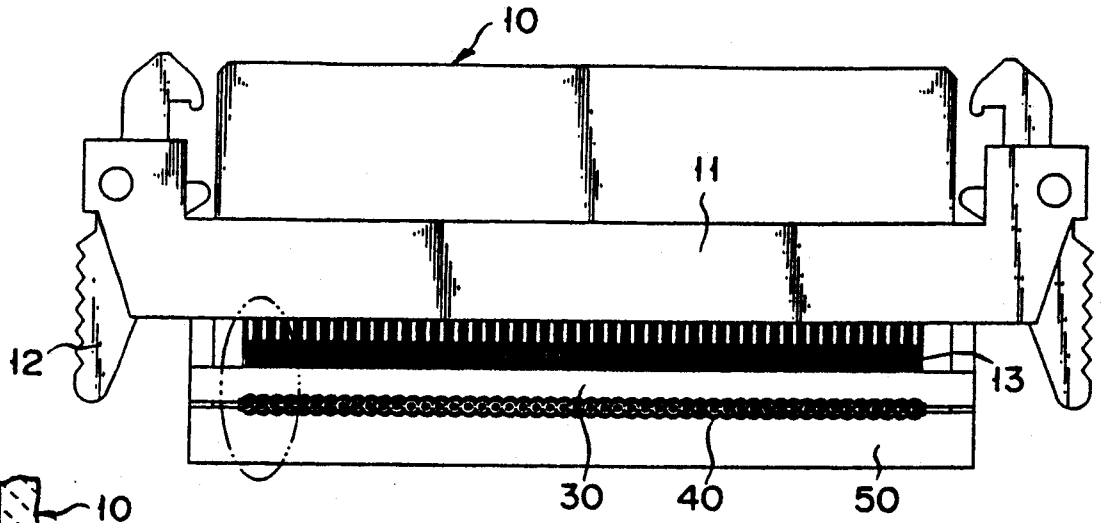
FIG. 8A is an expanded view of the indicated portion of FIG. 8.
Figure 8B:
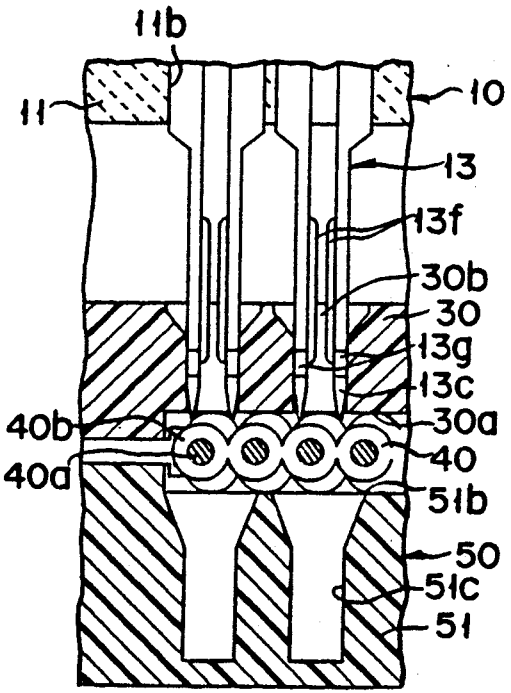
FIG. 8 is a front view of the connector of FIG. 7 which is in the first stage of a method according to the invention.

The third embodiment also has two lock levers 12. As is shown in FIGS. 8A and 8B which are perspective views, have a projection 12*a*, a pin 12*b*, a lock pawl 12*c*, a lift pawl 12*d*, and a holding portion 12*e*, as in the first embodiment. The lock pawl 12*c* of either lever 12 is tapered, getting thinner toward the lower ends. The lift pawl 12*d* and the holding portion 12*e* are formed on the opposing sides of either lever 12.

The third embodiment is identical to the first embodiment, except for the features specified above, and therefore achieves the same advantages as the first embodiment.

Figure 19A:
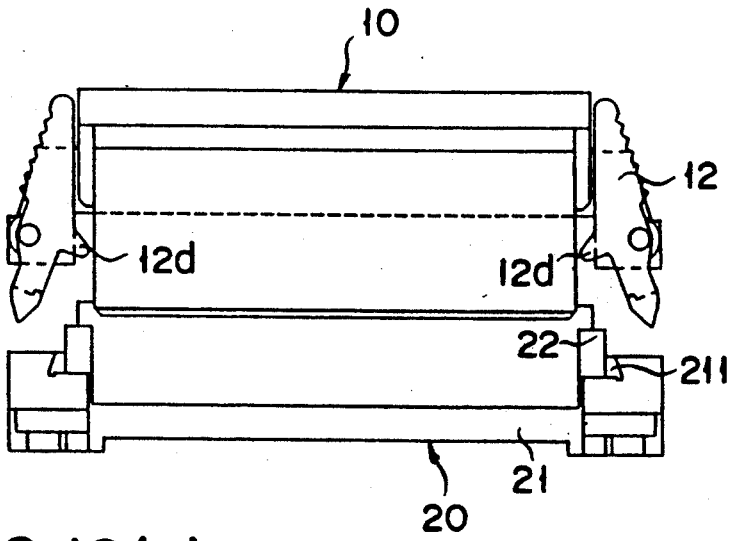
FIGS. 19(*a*) to 19(*c*) are views showing the connector (FIG. 17) and explaining how the plug is inserted into the receptacle.
Figure 19B:
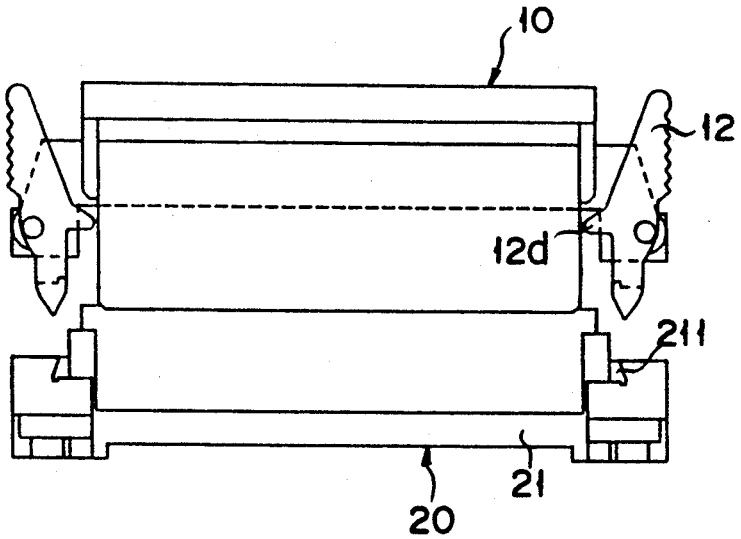
Figure 19C:
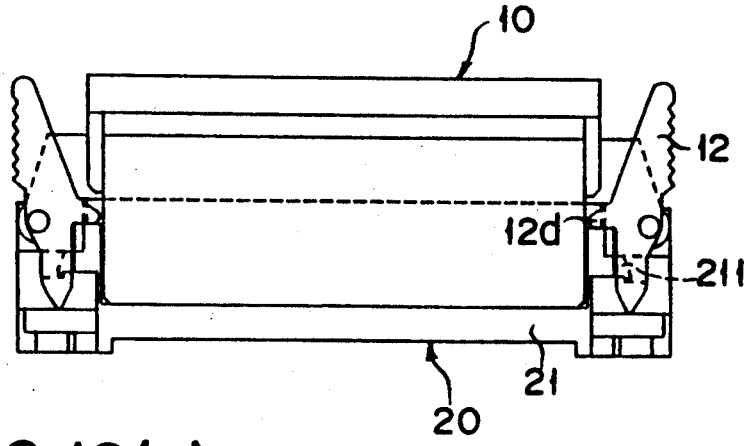
Figure 20:
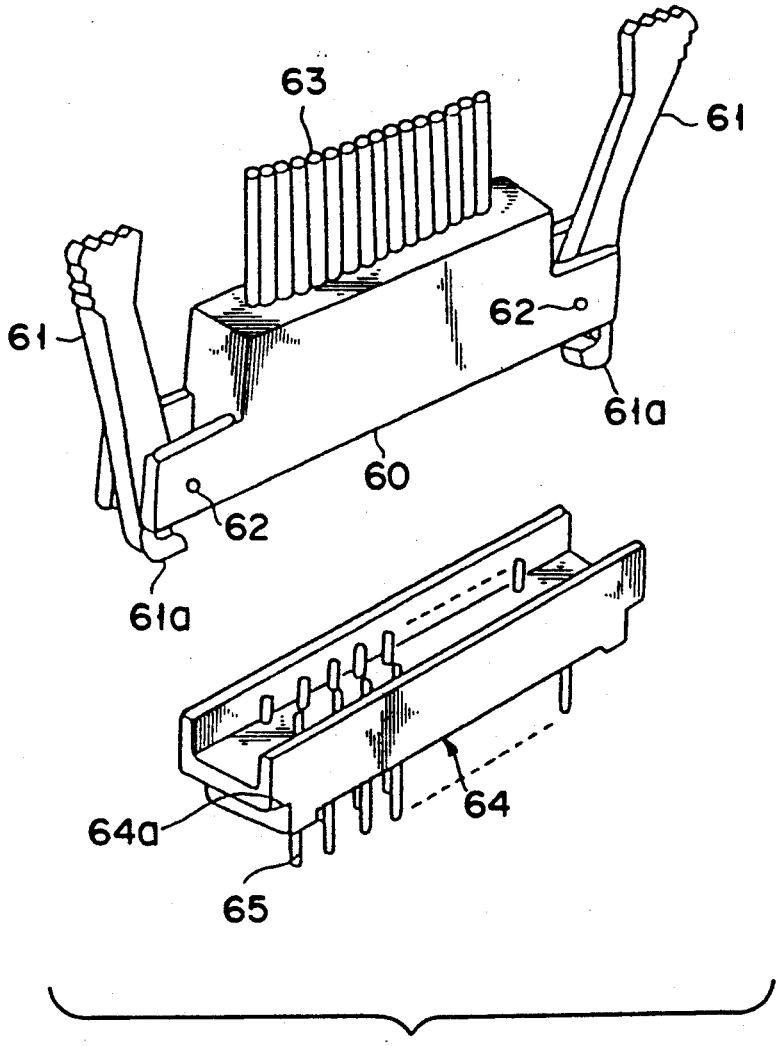
FIG. 20 is an exploded perspective view of a conventional two-piece connector.
Figure 21:
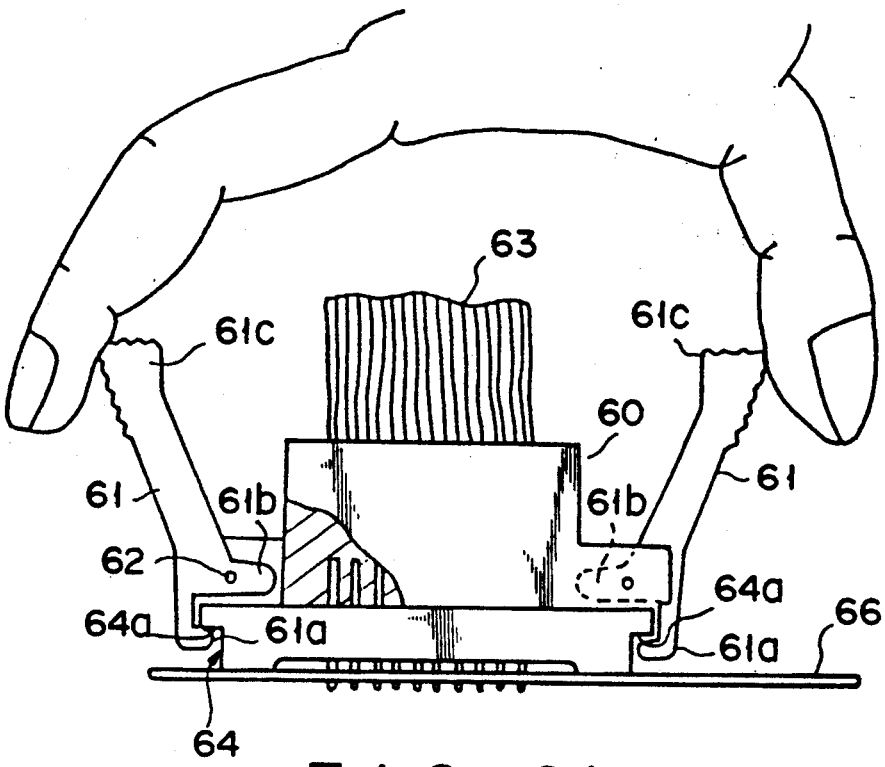
FIGS. 21 and 22 are views explaining how the conventional connector (FIG. 20) is removed.
Figure 22:
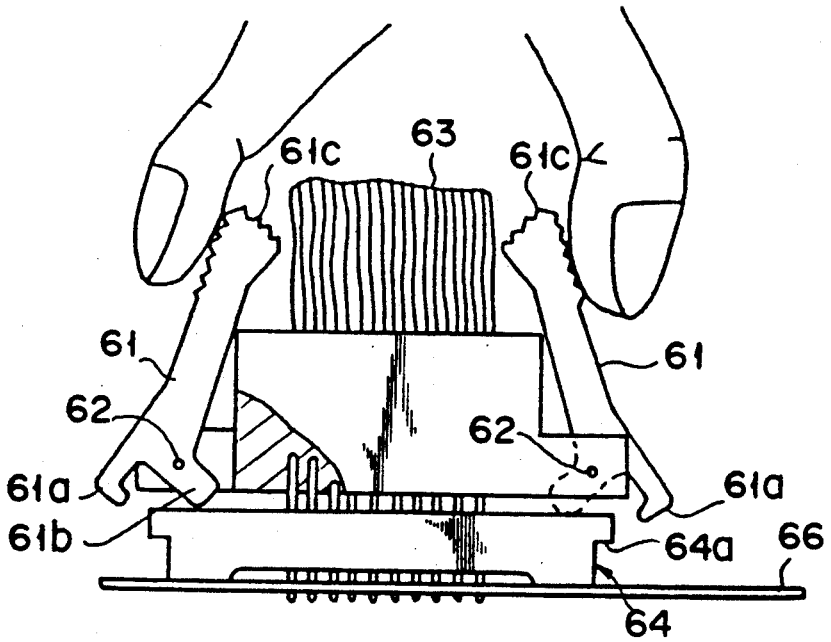

FIGS. 19(*a*) and 19(*b*) show the third embodiment in the initial stage of inserting the receptacle 10 into the header 20. More specifically, FIG. 19(*a*) shows the lock levers 12 opened, whereas FIG. 19(*b*) illustrates the levers 12 closed. FIG. 19(*c*) shows the third embodiment, with the receptacle 10 completely inserted in the header 20.

In the embodiments described above, the receptacle 10 is pressed onto the first cover 30 after the cover 30 has been placed on the flat cable 40. Instead, the receptacle 10 can be inserted into the cover 30, and then both the receptacle 10 and the cover 30, confined together can be pressed onto the flat cable 40.

In summary, any structure falls in the scope of this invention as long as surface contact does not occur between the lock lever 12 and the lock lever engaging body 22 or between the lock lever 12 and the header insulator 21 upon inserting the receptacle 10 in the header 20 when the lock levers 12 are in a closed state.

In the above embodiments, the flat cable 40 is connected with the connector under pressure. However, this invention is applicable to any two-piece connector comprising the receptacle 10 and the header 20.

What is claimed is:

1. A method of press-connecting a flat cable, comprising the steps of:

forming a receptacle body by inserting press-type contacts into a plurality of holes formed in an insulator having upper and lower faces joined by end faces and projections protruding from the end faces, such that press-contacting portions of said press-type contacts project from said insulator;

placing a second cover in grooves formed in a press-contact jig, said cover having engaging frame portions on both end portions, and cable locating grooves in one surface;

placing a flat cable in said cable locating grooves of said second cover supported on said press-contact jig, said flat cable comprising a layer made of electrically insulating material and a plurality of parallel insulated cores embedded in the layer;

placing a first cover such that said engaging frame portions of said second cover are fitted in guiding grooves formed in both end portions of the first cover, and that cable locating grooves made in that surface of the first cover which opposes the said second cover oppose the flat cable, said first cover having a plurality of holes for receiving the press-contacting portions and aligning the press-contacting portions with respective cable locating grooves;

engaging said engaging frame portions of said second cover with the projections of said receptacle insulator thereby preliminarily clamping the flat cable with the insulated cores aligned by the respective cable locating grooves with the respective press-contacting portion receiving holes, and inserting the press-contacting portions of said press-type contacts into the holes of said first cover; and cutting the layer of said flat cable by said press-contacting portions of said press-type contacts by pushing said receptacle body towards said second cover, thereby electrically connecting said cores with the press-contacting portions of said press-type contacts.

2. A method of press-connecting a flat cable, comprising the steps of:

forming a receptacle body by inserting press-type contacts into a plurality of holes formed in a receptacle insulator having upper and lower faces joined by end faces and projections protruding from the end faces, such that press-contacting portions of said press-type contacts project from said receptacle insulator;

inserting the press-contacting portions of said press-type contacts into holes made in a first cover, thereby fastening said receptacle body and said first cover together, said first cover having guiding grooves formed on both ends, and cable locating grooves in the surface facing away from said receptacle insulator;

placing a second cover in grooves formed in a press-contact jig, said cover having engaging frame portions on both end portions, and cable locating grooves in one surface;

placing a flat cable in said cable locating grooves of said second cover supported on said press-contact jig, said flat cable comprising a layer made of electrically insulating material and a plurality of parallel insulated cores embedded in the layer;

placing said first cover such that said engaging frame portions of said second cover are fitted in guiding grooves of said first cover fastened to said receptacle body, and that said cable locating grooves of said first cover face the flat cable;

engaging said engaging frame portions of said second cover with the projections of said receptacle insulator thereby preliminary holding the respective insulated cores of the flat cable in the respective cable locating grooves of both the first and second covers; and cutting the layer of said flat cable by said press-connecting portions of said press-type contacts by pushing said receptacle body towards said second cover, thereby electrically connecting said cores with the press-contacting portions of said press-type contacts.

3. An electrical connector for flat cable comprising:

an insulating housing having an elongate, wire-connecting face and end faces extending away from the wire-connecting face;

contacts each having a wire-connecting portion comprising a pair of opposed wire engaging arms with insulation penetrating leading ends and defining between them a wire receiving slot extending away from the ends;

the contacts being mounted in the insulating housing with the respective wire-connecting portions upstanding from the wire-connecting face in a longitudinally extending row at a predetermined pitch with insulation penetrating ends uppermost;

first and second cover members of insulating material, the first cover member being formed with oppositely directed, elongate cable locating and contact receiving faces, a row of through-holes at said pitch extending therethrough between the faces and a row of insulated wire locating grooves aligned with respective through-holes;

the second cover member having an elongate cable engaging face formed with a row of contact receiving recesses at the said pitch and a row of insulated wire locating grooves aligned with respective through-holes;

the first cover member being retainable assembled on the wire connecting face of the housing in a preliminary position by receipt of the wire engaging arms as interference fits in respective through-holes in the first cover member thereby aligning accurately the respective wire connecting portions with corresponding insulated wire locating grooves, the assembly formed and the second cover member being relatively moveable together, cable locating faces adjacent, and with their corresponding wire locating grooves in alignment into clamping and aligning relation with individual insulated wire portions of a flat cable with respective connecting portions and into a final, wire connecting position in which the cable penetrating ends of the wire connecting portions are driven out from the first cover member through the cable into the contact receiving recesses of the second cover member with respective cable wires being received in respective slots establishing permanent electrical connection therewith.

4. An electrical connector according to claim 3 in which latch means are formed on the housing and on the second cover member for latching, releasably, the second cover member on the housing adjacent the first cover member in the preliminary position and to permit relative movement of the first and second cover members and a housing to the final, wire-connecting position.

5. An electrical connector according to claim 3 in which the wire engaging arms are receivable as interference fits in respective recesses of the second cover member.

6. An electrical connector according to claim 3 in which the wire engaging arms are prevented from expanding apart by receipt in the contact receiving recesses of the second cover.

7. An electrical connector according to claim 3 in which cable locating projections and recesses are formed at respective opposite ends of the cable locating face of the first cover member for receiving the projections in the preliminary position of assembly for locating the cable between them, longitudinally of the cable locating faces.

8. An electrical connector according to claim 3 in which latching and guiding means are provided at ends of the second cover member and the connector housing and are interengageable to latch the second cover member on the assembly in the preliminary position.

9. An electrical connector according to claim 3 in which leading ends of contacts do not protrude from the cable locating face in the preliminary position of assembly of the first cover member.

10. An electrical connector according to claim 3 in which the wire engaging arms are constituted by opposed plate portions which define between them the wire receiving slots.

11. An electrical connector according to claim 3 in which the opposed plate portions are prevented from expanding apart by receipt in an interference fit in the contact receiving recesses of the second cover member.

12. An electrical connector according to claim 10 in which each plate portion is formed with a projection adjacent a leading end, each projection forming the interference fit with a wall of a respective through-hole of the first cover member thereby to retain the first cover member assembled in the preliminary position.

13. An electrical connector according to claim 12 in which each of the projections extends laterally from a side edge of the with which it is formed and in substantially coplanar relation therewith.

14. A method of connecting respective insulated wires of a flat cable in a connector having contacts with insulation penetrating, press-connecting portions upstanding in a row at a predetermined pitch from a wire connecting face of the connector comprising the steps of:

providing a first insulating cover member formed with oppositely directed, elongate, cable locating and contact receiving faces, a row of through-holes at said pitch extending therethrough between the faces ad a row of insulated wire locating grooves aligned with respective through-holes;

mounting said first cover member on the housing in a preliminary position adjacent the wire connecting face to form a preliminary sub-assembly by engaging the respective press-connecting portions in respective through-holes and thereby accurately aligning the wire connecting portions with corresponding insulated wire locating grooves;

providing a second cover member comprising an elongate cable engaging face formed with a row of contact receiving recesses at said pitch and a row of insulated wire locating grooves aligned with respective recesses;

urging the second member and the sub-assembly relatively together with corresponding wire locating grooves in alignment about a flat cable thereby aligning respective insulated cores of the flat cable with respective press connecting portions and subsequently thereby shifting the first cover relatively towards the wire connecting face of the housing to a final position driving the press connecting portions relatively out from the first cover member through the cable into the contact receiving recesses of the second cover member effecting permanent electrical connection with respective wires of the cable.

15. A method of connecting flat cable according to claim 14 including the step of supporting the second cover member in a jig, cable locating face outermost, locating the flat cable thereon and continuing to support the second cover member int he jig during such relative movement to the final wire-connecting position.

16. A method of connecting flat cable according to claim 14 including the step of mounting the second cover member on the sub-assembly in the preliminary position with the flat cable clamped between the second and first cover members by engaging latches on ends of the second cover member and the housing.

17. A method of connecting respective insulated wires of a flat cable to respective insulation displacement contacts each comprising a pair of opposed plates defining between them a wire receiving slot extending away from a leading edge, each plate having at least one coplanar projection extending laterally from a side edge adjacent the leading edge, the contacts being mounted at a predetermined pitch in a row upstanding from a wire connecting face of an insulating housing, comprising the steps of:

securely mounting a first, elongate insulating cover having transversely extending, insulated wire receiving located grooves at the said pitch on a cable locating face and contact-receiving through-holes extending between respective grooves and an opposite face by receiving the plates concealed therein with the projections providing interference fits with walls of the through-holes;

supporting a second elongate insulating cover having insulated wire locating grooves extending transversely of an outer cable locating face at the same pitch as the grooves on the first cover on a jig;

locating the cable on the wire locating grooves of the second cover;

accurately locating the first cover retained on the contacts on the cable so that the corresponding grooves are on the first and second covers are in precise alignment and pressing the sub-assembly and the second cover together thereby receiving respective insulated wires in respective wire-receiving grooves of both covers in precise alignment with respective through-holes;

further pressing the jig and connector housing relatively together disengaging the projections from the through-holes of the first cover with the leading edges of the plates piercing the respective insulating sheaths of the cable and receiving the respective wires in the slots.

18. A method according to claim 17 including the step of forcing leading edges of respective plates into interference fits in respective recesses of respective grooves of the second cover thereby to prevent the plates from spreading apart.

19. A method according to claim 18 including the step of latching the second cover to the housing to retain the cable clamped between the first and second covers in the preliminary position.

* * * * *